US007775825B2

(12) United States Patent
Wu

(10) Patent No.: US 7,775,825 B2
(45) **Date of Patent: *Aug. 17, 2010**

(54) CABLE CONNECTOR ASSEMBLY HAVING STRAIN RELIEF MEMBER FOR CABLE

(75) Inventor: Jerry Wu, Irvine, CA (US)

(73) Assignee: Apple Inc., Cupertino, CA (US)

( * ) Notice: Subject to any disclaimer, the term of this patent is extended or adjusted under 35 U.S.C. 154(b) by 127 days.

This patent is subject to a terminal disclaimer.

(21) Appl. No.: 12/154,739

(22) Filed: May 27, 2008

(65) Prior Publication Data

US 2009/0298322 A1 Dec. 3, 2009

(51) Int. Cl.
*H01R 13/58* (2006.01)

(52) U.S. Cl. ..... 439/460

(58) Field of Classification Search ..... 439/607.52, 439/607.45, 465, 470, 369
See application file for complete search history.

(56) References Cited

U.S. PATENT DOCUMENTS 4,861,284 A * 8/1989 Pauza et al. ..... 439/470
5,961,351 A * 10/1999 Wu ..... 439/607.45
6,663,415 B1 12/2003 Wu
6,706,970 B2 3/2004 Laub
7,247,046 B1 7/2007 Wu
7,306,479 B1 12/2007 Wu

* cited by examiner

*Primary Examiner*—Briggitte R Hammond
(74) *Attorney, Agent, or Firm*—Townsend and Townsend and Crew LLP

(57) ABSTRACT

A cable connector assembly (100) in accordance with the present invention includes a housing (1), a terminal (2), a sleeve (5), and a strain relief member (7). The housing includes a mating end (11), a soldering end (12), and a passage formed through the mating and soldering ends. The terminal is received in the passage of the housing and includes a mating portion (21) exposed in the mating end and a soldering portion (22) extending beyond the soldering end of the housing and soldered to a cable (3). The sleeve is mounted to enclose a contact junction (8) between the cable and the terminal, and the strain relief member is molded over a part of the cable and the sleeve.

19 Claims, 10 Drawing Sheets

CABLE CONNECTOR ASSEMBLY HAVING STRAIN RELIEF MEMBER FOR CABLE

BACKGROUND OF THE INVENTION

1. Field of the Invention

The present invention generally relates to a cable connector assembly, and more particularly to a cable connector assembly having a strain relief member for a cable.

2. Description of Related Art

Metal strain relief member is widely used in a cable connector assembly for providing mechanical support and grounding function to a cable. Usually, there are two types of strain relief member currently. One type is that a conductive shell forms a train relief section grasping a metal braiding layer of a cable to provide mechanical support and grounding function. The other type is that a cable connector assembly has a separate strain relief member comprising a strain relief section grasping a metal braiding layer of the cable and electrically connects with a metal shell of the cable connector assembly to realize mechanical support and grounding function, such as disclosed in U.S. Pat. Nos. 6,706,970B2, 6,663,415B1.

BRIEF SUMMARY OF THE INVENTION

An object of the present invention is to provide a cable connector assembly having a stain relief member with thereof a sleeve for enclosing contact junctions between a cable and terminals.

In order to achieve the above-mentioned object, a cable connector assembly in accordance with the present invention comprises a housing, a terminal, a sleeve, and a strain relief member. The housing comprises a mating end, a soldering end, and a passage formed through the mating and soldering ends. The terminal is received in the passage of the housing and comprises a mating portion exposed in the mating end and a soldering portion extending beyond the soldering end of the housing and soldered to a cable. The sleeve is mounted to enclose a contact junction between the cable and the terminal, and a strain relief member is molded over a part of the cable and the sleeve.

Other objects, advantages and novel features of the invention will become more apparent from the following detailed description of the present embodiment when taken in conjunction with the accompanying drawings.

DETAILED DESCRIPTION OF THE INVENTION

Figure 1:
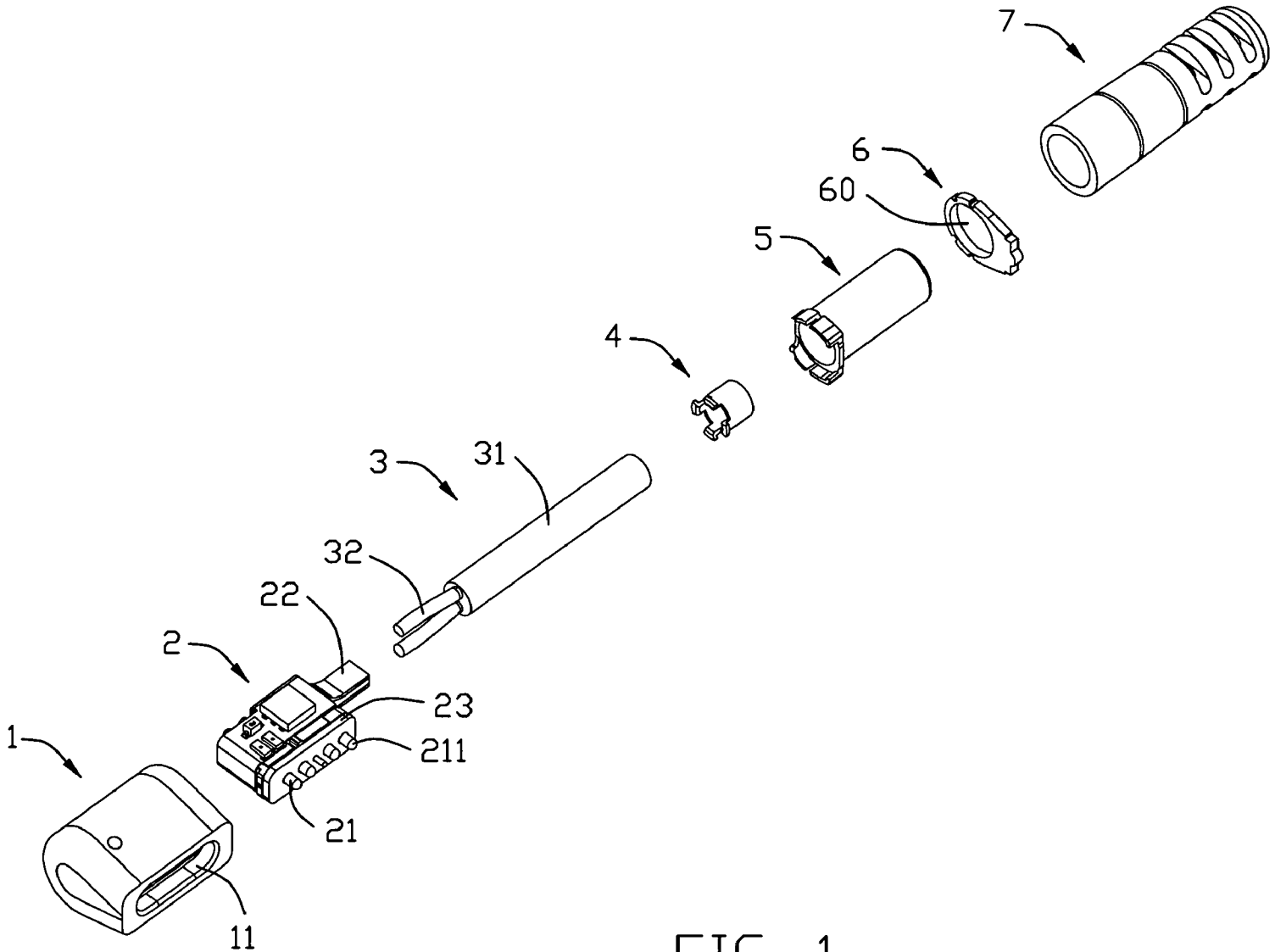
FIG. 1 is an exploded, perspective view of a cable connector assembly in accordance with the first embodiment of the present invention.

Reference will now be made to the drawing figures to describe the present invention in detail.

Figure 2:
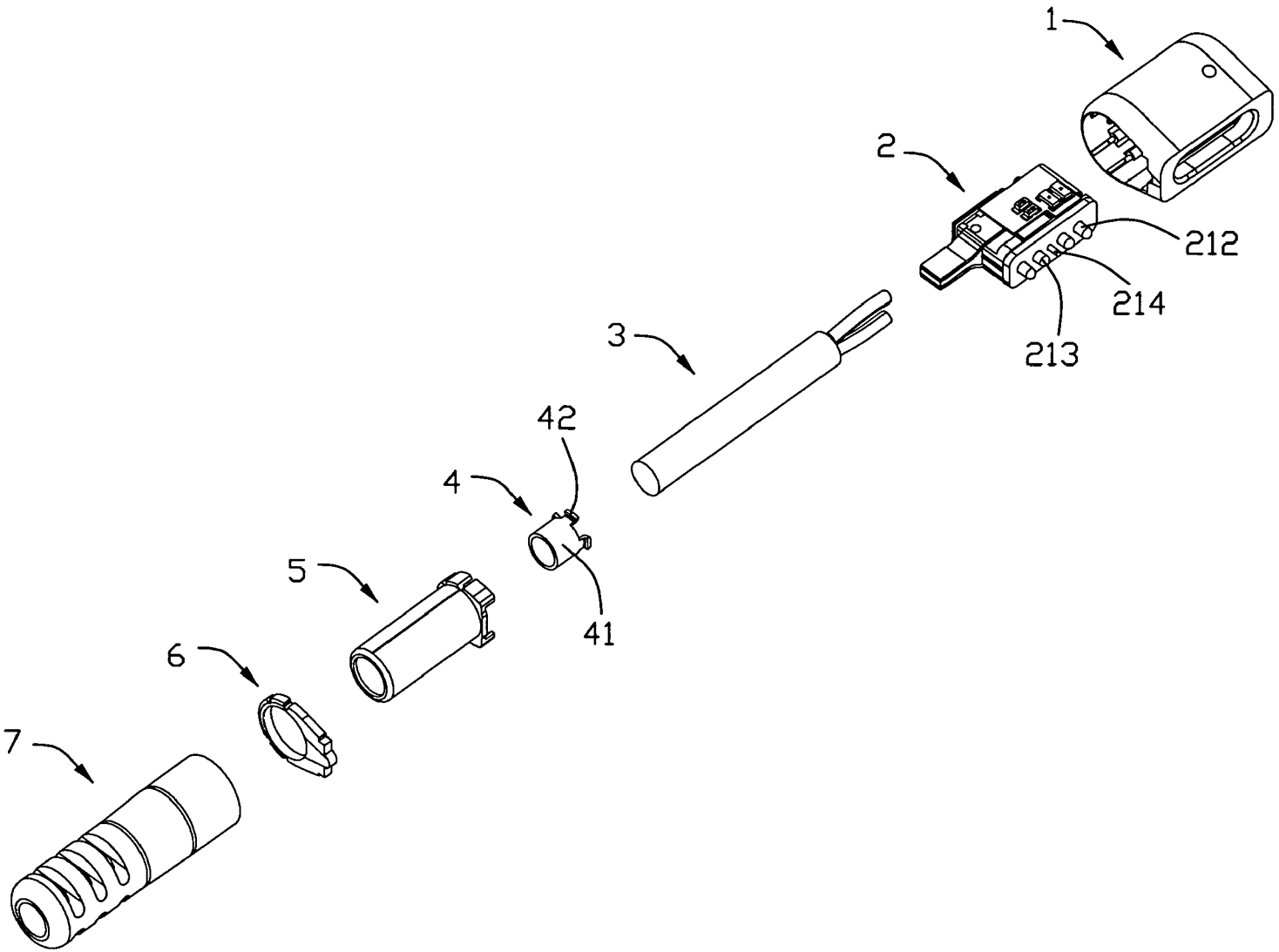
FIG. 2 is a view similar to FIG. 1, but viewed from a different aspect.
Figure 3:
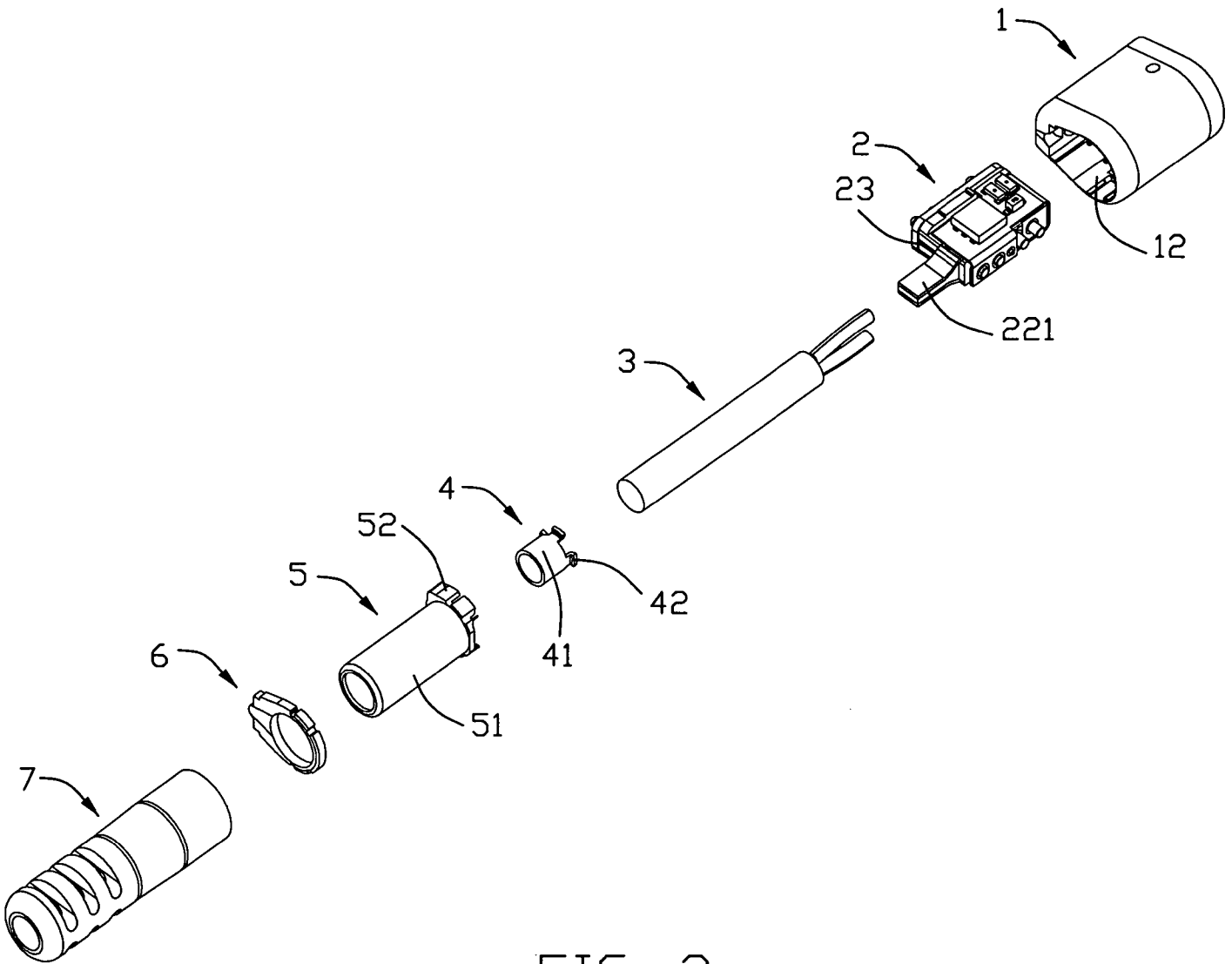
FIG. 3 is a view similar to FIG. 1, but viewed from another different aspect.
Figure 4:
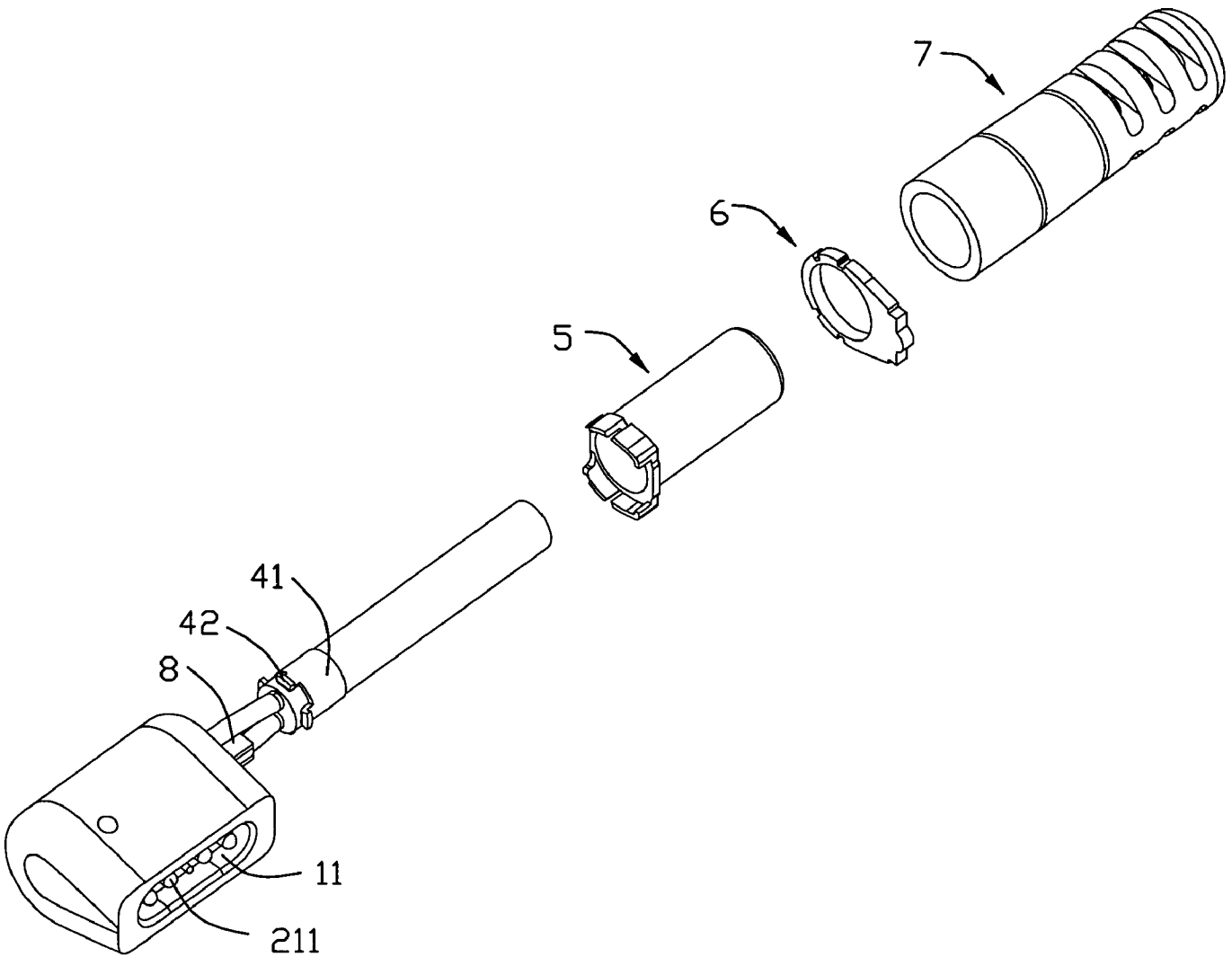
FIG. 4-8 show assembling process of the cable connector assembly.
Figure 5:
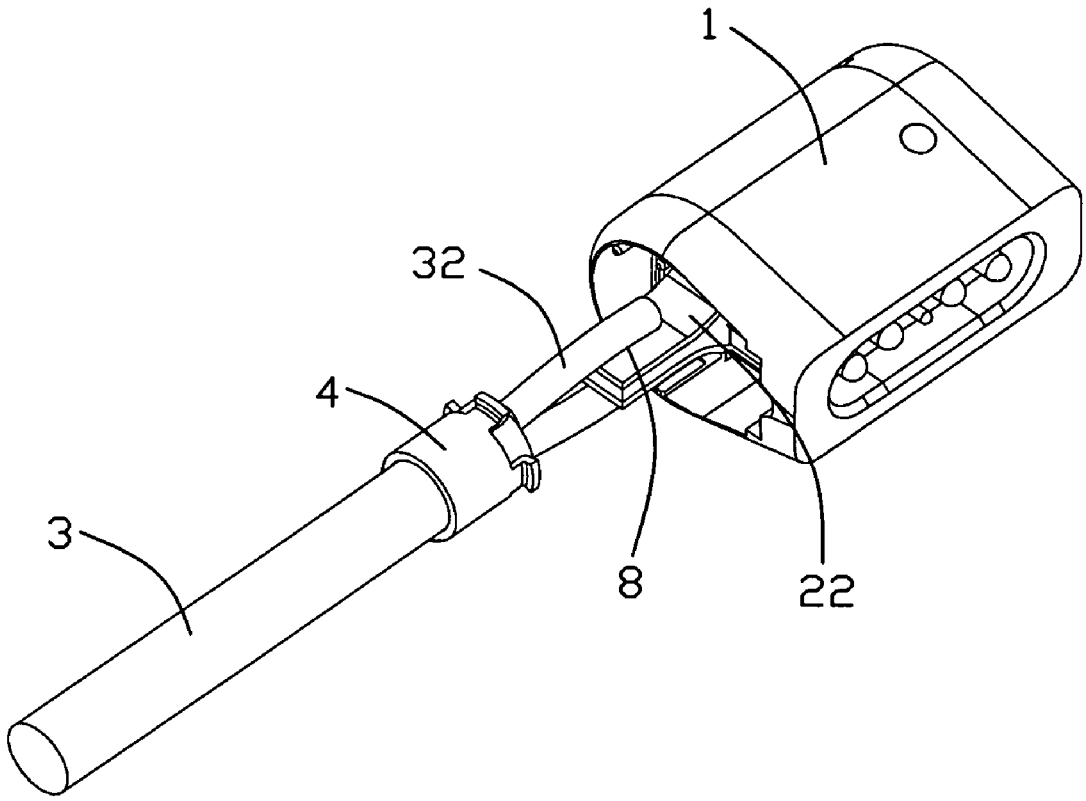
Figure 6:
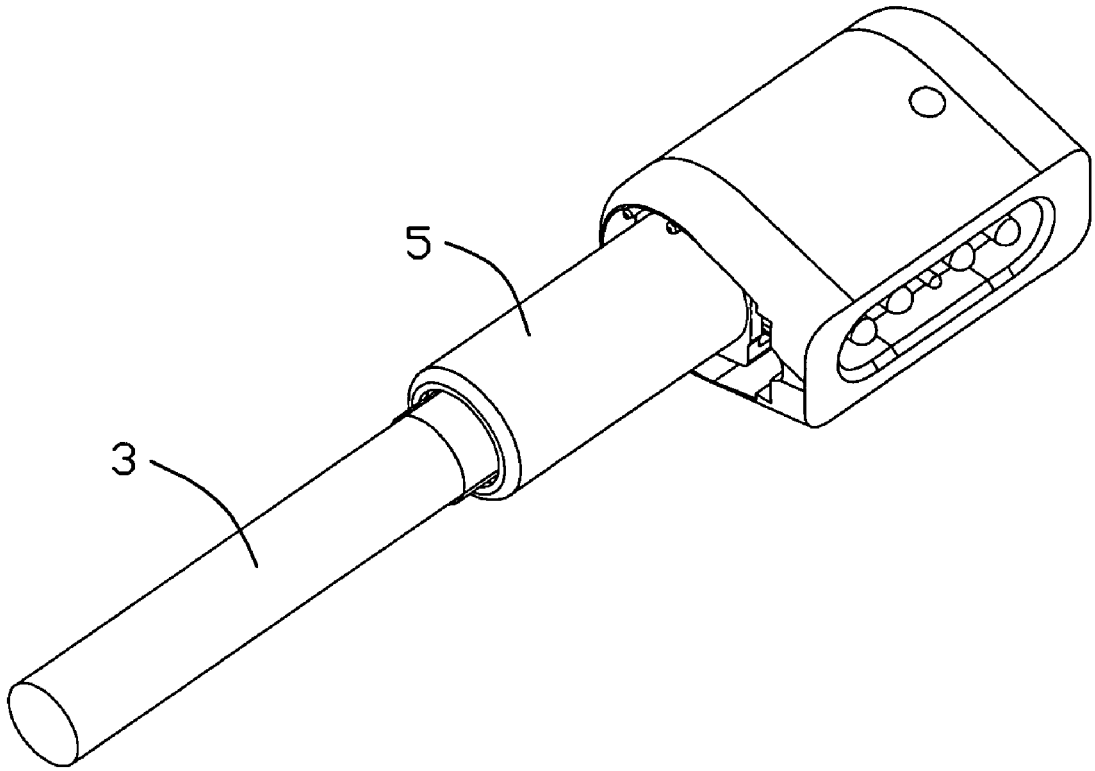
Figure 7:
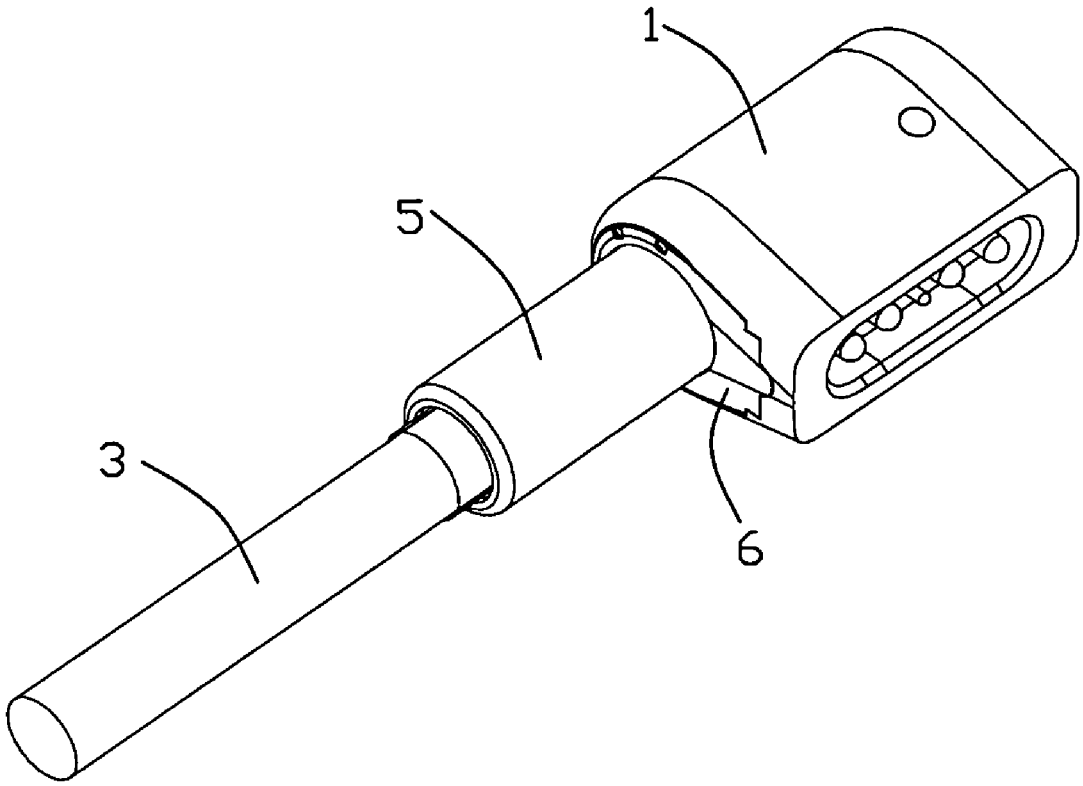
Figure 8:
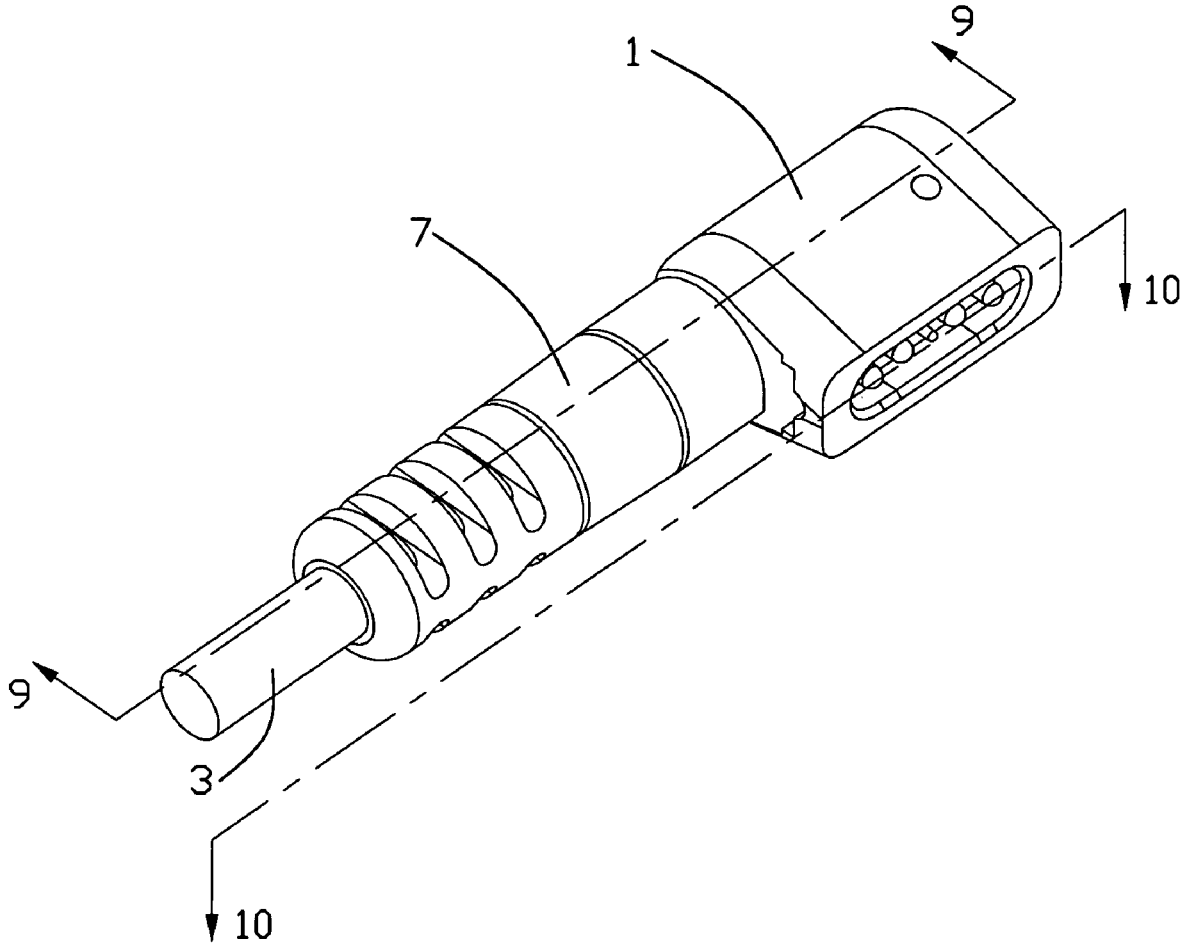
Figure 9:
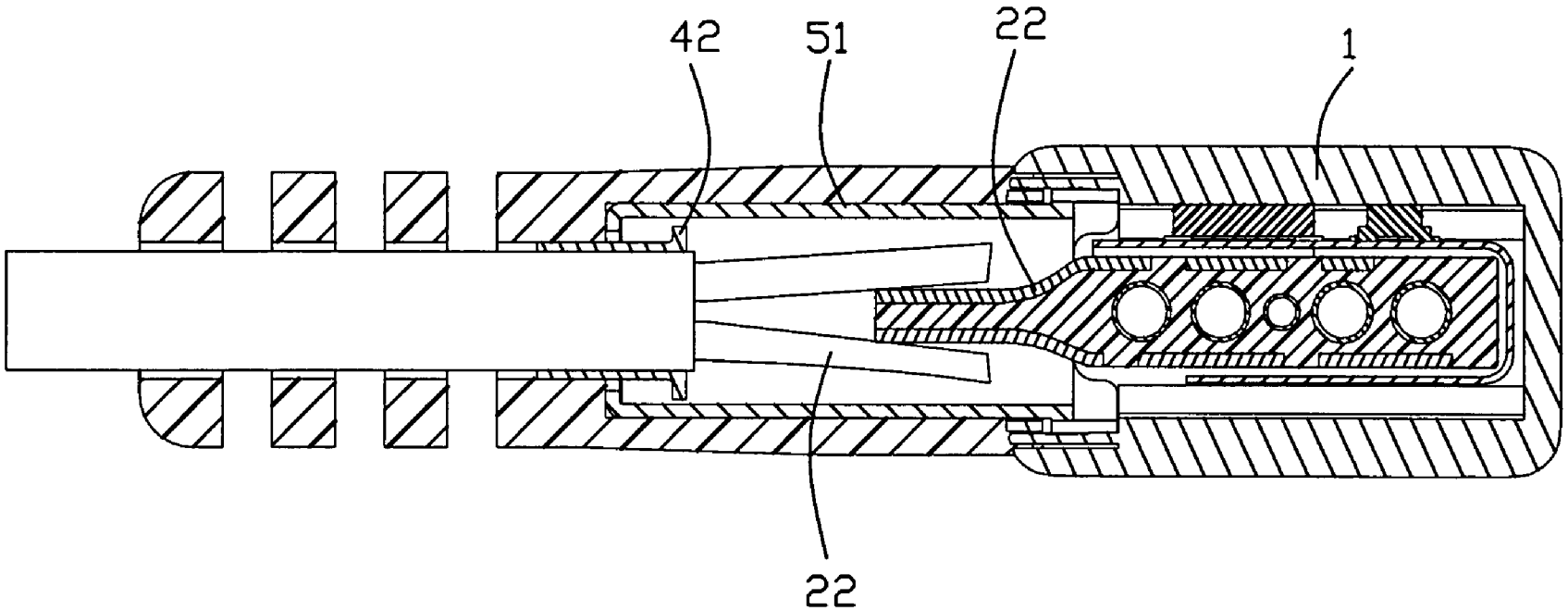
FIGS. 9-10 are cross-section views taken along lines 9-9 to 13-13 of FIG. 8.
Figure 10:
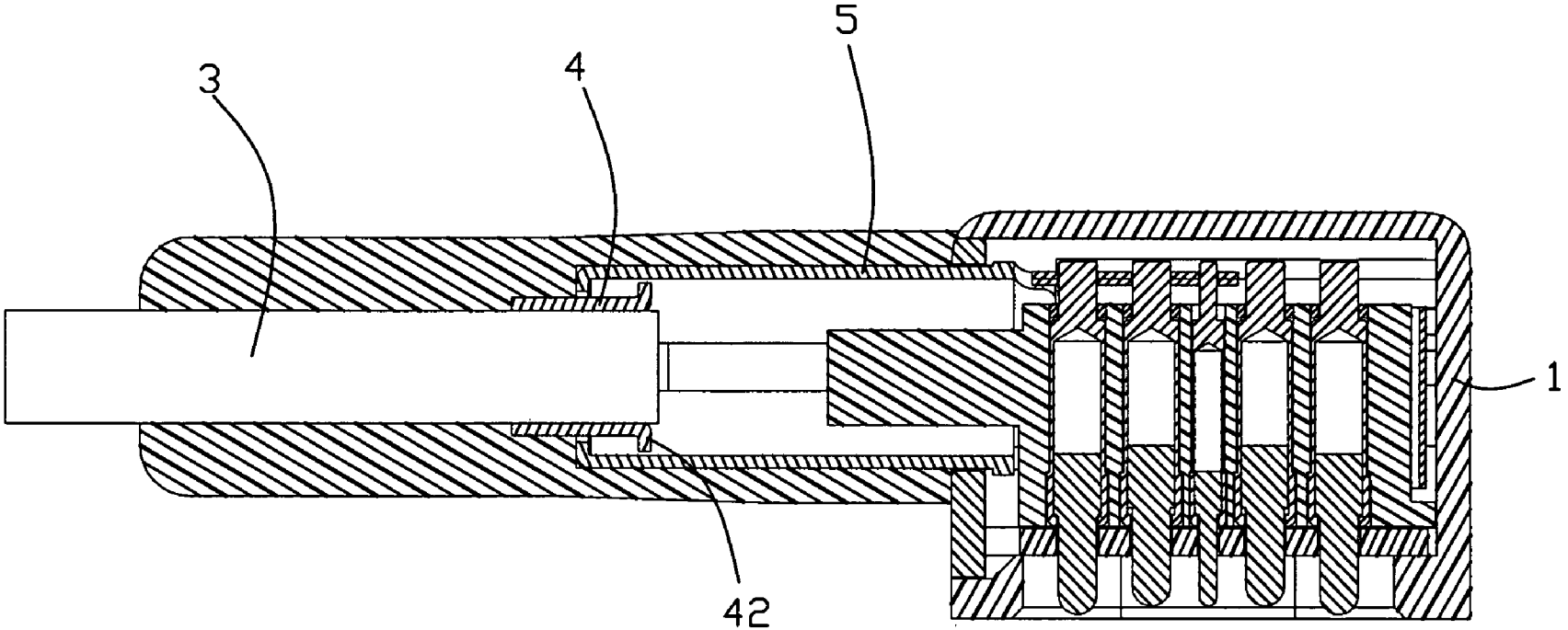

Referring to FIGS. 1-3, a cable connector assembly 100 in accordance with the present invention comprises a housing 1, a terminal assembly 2 assembled to the housing 1, a round cable 3 soldered to the terminal assembly 2, a rigid sleeve 5 covering a contact junction 8 between the terminal assembly 2 and the round cable 3, and a strain relief member 7 molded over the rigid sleeve 5 and a part of the round cable 3.

The housing 1 is made of metal and comprises a mating port 11 opening to the left so as to mate with a complementary connector and a soldering port 12 opening to the rear so as to accommodate the round cable 4. The mating port 11 and the soldering port 12 communicate with each other and receive the terminal assembly 2 therein.

The terminal assembly 2 comprises a terminal block 23, five mating members 21 held in the terminal block 23, a plurality of function elements 24 held on surfaces of the terminal block 23 and electrically connecting with the mating members 21, and a pair of soldering members 22 electrically connecting with the function elements 24. The mating members 21 is received in the terminal block 23, with front portions 211 of the mating members 21 extending beyond the terminal block 23 so as to mate with a complementary connector. Tail portions 221 of the soldering members 22 extends beyond the terminal block 23 and the housing 1 so as to be soldered to the round cable 3.

The mating members 21 consist of a pair of ground terminals 212, a pair of power terminals 213 located between the pair of ground terminals 212 and a center detect terminal 214 located between the pair of power terminals 213. Each mating member 21 is of a POGO Pin type, that is to say, there is a spring (not shown) inside the mating member 21, thus, when mating, the mating member 21 can be pressed to rearward move along the mating direction. One of the pair of soldering members 22 electrically connects with the pair of power terminals 213 for transmitting positive electricity, and the other electrically connects with the pair of ground terminals 212 for transmitting negative electricity.

The round cable 3 comprises an insulative jacket 31 at the outermost thereof and a pair of conductive conductors 32 enclosed by the insulative jacket 31 for transmitting power. A front portion of the insulative jacket 31 is stripped to expose part of the conductive conductors 32.

A cable clamp 4 which is made of metal is mounted on the cable 3, and comprises a tubular crimper 41 mounted and crimped on outer surfaces of the round cable 3 and a hook 42 holding the sleeve 5.

The rigid sleeve 5 is made of metal and comprises a tube 51 covering the contact junctions 8 between the round cable 3 and the soldering members 22, and an enlargement 52 extending forwards into the opening 12 of the housing 1 and holding on the housing 1.

A gasket 6 with an opening 60 in the center thereof passes through the tube 51 of the sleeve 5 and abuts against the enlargement 52 so as to hold the sleeve 5 on the housing 1. The gasket 6 is also made of metal.

In assembly, please referring to FIGS. 4-10, at first the gasket 6 is assembled onto the sleeve 5 along the tube 51 from the rear, and the cable clamp 4 is inserted from the front into the tube 51 of the sleeve 5 with the tubular crimper 41 extending beyond the sleeve 5 and exposed outside. Then the front portion of the round cable 3 is inserted into the sleeve 5 with the conductive conductors in the front exposed outside the sleeve 5. Thirdly, solder the conductive conductors to the soldering members 22. Fourthly, the sleeve 5 slides along the round cable 3 so that the tube 51 covers the contact junctions 8 and the enlargement 52 enters into the opening 12 of the housing 1. Fifthly, the gasket 6 is inserted into and engages with the opening 12 of the housing 1 to prevent the enlargement 52 from withdrawing from the opening 12, and press the tubular crimper 41 inwards so the cable clamp 4 holds on the round cable 3. The housing 1, the gasket 6, the rigid sleeve 5 and the cable clamp 4 are soldered to each other. Finally, the strain relief member 7 is molded over a part of the round cable 3 and the rigid sleeve 5.

The sleeve 5 is mounted to cover the contact junction 8 between the round cable 3 and the soldering member 22 so that the contact junction 8 isn't destroyed when the strain relief member 7 is molded. Moreover, the sleeve 5 is rigid and can strengthen the rigidity of the round cable 3.

Other structures and assembly process of the cable connector assembly 200 same as those of the cable connector assembly 100 are omitted here.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a housing comprising a mating end, a soldering end, and a passage formed through the mating and soldering ends;

a terminal received in the passage of the housing and comprising a mating portion exposed in the mating end and a soldering portion extending beyond the soldering end of the housing and soldered to a cable;

a sleeve mounted to enclose a contact junction between the cable and the terminal; and a strain relief member molded over a part of the cable and the sleeve.

2. The cable connector assembly as claimed in claim 1, wherein the sleeve extends forwards into the housing so as to be held on the housing, and extends backwards to hold the cable.

3. The cable connector assembly as claimed in claim 1, wherein a cable clamp is mounted on the cable, and comprises a tubular crimper mounted and crimped on outer surfaces of the cable and a hook holding the sleeve.

4. The cable connector assembly as claimed in claim 3, wherein the sleeve comprises a tube covering the contact junction between the cable and the terminal, and an enlargement extending forwards into an opening of the housing and holding on the housing.

5. The cable connector assembly as claimed in claim 4, wherein further comprises a gasket with an opening in the center thereof, and the gasket passes through the tube of the sleeve and abuts against the enlargement so as to hold the sleeve on the housing.

6. The cable connector assembly as claimed in claim 5, wherein the gasket is shaped to near perfect match with the opening of the housing.

7. The cable connector assembly as claimed in claim 1, wherein the sleeve comprises a tube covering the contact junction between the cable and the terminal, and an enlargement extending forwards into an opening of the housing and holding on the housing.

8. The cable connector assembly as claimed in claim 1, wherein the cable connector comprises a pair of soldering portions, one of which electrically connects at least two mating portions for transmitting positive electricity, the other of which electrically connects at least two mating portions for transmitting negative electricity.

9. A cable connector assembly, comprising:

a housing comprising a mating end and a soldering end defining an opening;

a terminal comprising a mating portion received in the mating end and a soldering portion extending beyond the opening of the housing so as to be soldered to a cable; and a rigid sleeve mounted to cover a contact junction between the cable and the terminal, the sleeve extending forwards into the opening of the housing so as to be held on the housing, the sleeve extending backwards to hold the cable.

10. The cable connector assembly as claimed in claim 9, wherein a strain relief pipe is molded and encloses the sleeve and a part of the cable.

11. The cable connector assembly as claimed in claim 9, wherein a cable clamp is mounted on the cable, and comprises a tubular crimper mounted and crimped on outer surfaces of the cable and a hook holding the sleeve.

12. The cable connector assembly as claimed in claim 9, wherein the sleeve comprises a tube covering the contact junction between the cable and the terminal, and an enlargement extending forwards into the opening of the housing and holding on the housing.

13. The cable connector assembly as claimed in claim 12, wherein further comprises a gasket with an opening in the center thereof, and the gasket passes through the tube of the sleeve and abuts against the enlargement so as to hold the sleeve on the housing.

14. The cable connector assembly as claimed in claim 13, wherein the gasket is shaped to near perfect match with the opening of the housing.

15. The cable connector assembly as claimed in claim 9, wherein the cable connector comprises a pair of soldering portions, one of which electrically connects at least two mating portions for transmitting positive electricity, the other of which electrically connects at least two mating portions for transmitting negative electricity.

16. A cable connector assembly comprising:

an insulative housing defining a mating port facing in a first direction and a connection port facing in a second direction different from said first direction;

a plurality of contacts disposed in the housing, each of said contacts defining a mating section in said mating port, and a connection section in said connection port;

a cable having an outer jacket enclosing a plurality of wires which are connected to the connection sections of the corresponding contacts, respectively;

a sleeve extending along an axial direction primarily behind the housing, and surrounding a joint area of said connection sections and said wires; and a gasket embedded in the housing and forwardly abutting against a front end of said sleeve to in said axial direction so as to prevent the sleeve from moving rearwardly away from the housing.

17. The cable connector assembly as claimed in claim 16, further including a cable clamp located around a front end of the jacket and having a front end received in the sleeve.

18. The cable connector assembly as claimed in claim 16, wherein the first direction is perpendicular to the second direction, and said housing defines a larger dimension in said first direction than in a third direction which is perpendicular to both said first and second direction, and the gasket is configured to define a greater dimension along said first direction than any other directions in a plane defined by said first direction and said third direction.

19. The cable connector assembly as claimed in claim 18, wherein said gasket essentially surrounds the sleeve.

* * * * *